US009758282B2

(12) United States Patent
Reinhart

(10) Patent No.: US 9,758,282 B2
(45) Date of Patent: Sep. 12, 2017

(54) DOCUMENT BOX WITH HOLD OPEN FEATURE

(71) Applicant: Creative Plastic Concepts, LLC, Sycamore, OH (US)

(72) Inventor: Nickolas Reinhart, Findlay, OH (US)

(73) Assignee: Creative Plastic Concepts, LLC, Sycamore, OH (US)

( * ) Notice: Subject to any disclaimer, the term of this patent is extended or adjusted under 35 U.S.C. 154(b) by 78 days.

(21) Appl. No.: 15/006,190

(22) Filed: Jan. 26, 2016

(65) Prior Publication Data

US 2016/0221731 A1 Aug. 4, 2016

Related U.S. Application Data

(60) Provisional application No. 62/109,334, filed on Jan. 29, 2015.

(51) Int. Cl.
*B65D 43/24* (2006.01)
*B65D 43/16* (2006.01)

(52) U.S. Cl.
CPC ..... *B65D 43/24* (2013.01); *B65D 43/165* (2013.01); *B65D 2251/1008* (2013.01); *B65D 2543/00194* (2013.01); *B65D 2543/00537* (2013.01); *B65D 2543/00583* (2013.01)

(58) Field of Classification Search
CPC ..... E05D 11/00; E05C 17/00; B65D 43/24; B65D 43/163–43/165; B65D 43/0121; B65D 43/0222; B65D 2543/00583; B65D 2543/00537; B65D 2543/00194; B65D 2251/1008; B65D 1/34; B65D 1/36; A45C 11/34; A45C 11/36
USPC ..... 206/762, 759, 754, 751, 45.23, 45.2, 206/387.1, 307; 220/831, 832, 810
See application file for complete search history.

(56) References Cited

U.S. PATENT DOCUMENTS

| | | | | |
|---|---|---|---|---|
| D176,366 | S | 12/1955 | McFadyen | |
| 3,042,192 | A * | 7/1962 | Herrin | A45C 11/16 206/45.23 |
| 3,272,379 | A * | 9/1966 | Driza | A45C 13/34 217/60 G |
| D206,698 | S | 1/1967 | Edwards | |
| D216,514 | S | 1/1970 | Murray | |
| D257,778 | S | 1/1981 | Macowski | |
| D274,065 | S | 5/1984 | Goutchat | |
| D296,794 | S | 7/1988 | Leithauser | |
| D299,476 | S | 1/1989 | Wolff | |

(Continued)

*Primary Examiner* — Anthony Stashick
*Assistant Examiner* — Mollie Impink
(74) *Attorney, Agent, or Firm* — Ward Law Office LLC; Jacob M. Ward

(57) ABSTRACT

A document box includes a top container portion and a bottom container portion. The top container portion has a rear wall with a hollow rib integrally disposed thereon. The bottom container portion is rotatably coupled to the top container portion about an axis of rotation, and the top container portion is positionable between a closed position and an open position on the bottom container portion. The bottom container portion having a rear wall and a bottom wall. A raised member is positioned on the bottom wall adjacent to the rear wall. The top container portion where rotated to the open position releasably positions the raised member within the hollow recessed rib, thereby defining a hold open feature for the top container portion.

20 Claims, 4 Drawing Sheets

(56) References Cited

U.S. PATENT DOCUMENTS

| | | | |
|---|---|---|---|
| D303,993 | S | 10/1989 | Szablak et al. |
| D304,348 | S | 10/1989 | Dunn |
| D317,017 | S | 5/1991 | Kheng |
| D317,179 | S | 5/1991 | Kheng |
| D333,488 | S | 2/1993 | Kirchner |
| D338,494 | S | 8/1993 | Hofman |
| D362,273 | S | 9/1995 | Trombly |
| 5,623,778 | A | 4/1997 | Dunn |
| D407,120 | S | 3/1999 | Dunn et al. |
| D430,216 | S | 8/2000 | Dunn |
| D438,252 | S | 2/2001 | Trombly |
| D688,748 | S | 8/2013 | Nash et al. |
| D715,358 | S | 10/2014 | Reinhart |

* cited by examiner

DOCUMENT BOX WITH HOLD OPEN FEATURE

CROSS-REFERENCE TO RELATED APPLICATIONS

This application claims the benefit of U.S. Provisional Application No. 62/109,334, filed on Jan. 29, 2015, the entire disclosure of which is hereby incorporated herein by reference.

FIELD

The present disclosure relates to containers for holding items such as papers or documents and, more particularly, to document boxes with lids.

BACKGROUND

Containers such as document boxes can be used to retain and transport documents of various sizes. Such containers typically include a base or bottom portion, and a cover or top portion. The top portion is often removable to permit access to the documents received by the bottom portion. However, such removable top portions can be undesirably misplaced or lost.

A document box having the top portion connected to the bottom portion are known, and can mitigate against misplacement or loss of the top portion when the document boxes are opened. However, the connected top portion of known containers do not provide a positive stop at the top portion open position, or otherwise militate against the top portion from falling back to the closed position during use or movement of the container.

There is a continuing need for a document box that has hold open features for selectively holding a top portion of the document box in an open position. Desirably, the hold open features of the document box permit the top portion to remain in the open position for continuous access to items such as papers stored within the document box.

SUMMARY

In concordance with the instant disclosure, a document box that has hold open features for selectively holding a top portion of the document box in an open position, and which permit the top portion to remain in the open position for continuous access to items such as papers stored within the document box, is surprisingly discovered.

In one embodiment, a document box has a top container portion and a bottom container portion. The bottom container portion is rotatably coupled to the top container portion such that the top container portion is movable between a closed position and an open position. A raised member is positioned proximate to a rear wall of the bottom container portion. The raised member may be angled rearwardly, and with respect to a plane defined by a bottom wall of the bottom container portion. The top container portion where rotated to the container open position releasably positions the raised member within the hollow recessed rib, thereby defining a hold open feature for the top container portion.

In another embodiment, a document box includes a top container portion having a rear wall with a hollow rib integrally disposed thereon. The document box also has a bottom container portion rotatably coupled to the top container portion about an axis of rotation. The top container portion is positionable between a closed position and an open position.

The bottom container portion has a rear wall and a bottom wall, and an angled raised member positioned on the bottom wall adjacent to the rear wall. The angled raised member permits the top container portion to be rotated through an angle of rotation alpha ($\alpha$) greater than 90 degrees, relative to a plane defined by the bottom wall of the bottom container portion, from the closed position to the open position. The bottom container portion further has a contact rib extending outwardly from the bottom wall of the bottom container portion. The raised member is positioned between the contact rib and the rear wall of the bottom container portion.

The top container portion where rotated to the open position releasably positions the angled raised member within the hollow recessed rib, thereby defining a hold open feature for the top container portion. The contact rib also defines a rotational positive stop for the top container portion. The rear wall of the top container portion abuts the contact rib where the top container portion is in the open position.

In a further embodiment, a document box includes a top container portion and a bottom container portion. The top container portion has a rear wall with a hollow rib integrally disposed thereon. The top container portion further has a flanged edge and a raised outer rim with an opening formed therein. A handle portion is arranged on an outer wall of the top container portion between the opening in the raised outer rim and the flanged edge. The opening in the raised outer rim has a thumb-sized indentation centrally located within the opening. A pair of raised members are disposed on opposite sides of the handle portion and extend outwardly from an inner surface of the top container portion.

The bottom container portion is rotatably coupled to the top container portion about an axis of rotation, and the top container portion is positionable between a closed position and an open position on the bottom container portion. The top container portion is in peripheral contact with at least a portion of the bottom container portion where in the closed position. The bottom container portion has a rear wall and a bottom wall, and an angled raised member positioned on the bottom wall adjacent to the rear wall. The angled raised member permits the top container portion to be rotated through an angle of rotation alpha ($\alpha$) greater than 90 degrees relative to a plane defined by the bottom wall of the bottom container portion, from the closed position to the open position. The bottom container portion further has a contact rib that extends outwardly from the bottom wall of the bottom container portion. The raised member is positioned between the contact rib and the rear wall of the bottom container portion.

The top container portion, where rotated to the open position, releasably positions the angled raised member within the hollow recessed rib, thereby defining a hold open feature for the top container portion. The contact rib defines a rotational positive stop for the top container portion. The rear wall of the top container portion abuts the contact rib where the top container portion is in the open position. The top container portion, where rotated to the closed position, is selectively held by a cooperation of the raised members with a flange formed on a front wall of the bottom container portion.

DESCRIPTION OF THE DRAWINGS

The above, as well as other advantages of the present invention, will become readily apparent to those skilled in the art from the following detailed description of a preferred embodiment when considered in the light of the accompanying drawings in which.

DETAILED DESCRIPTION

Figure 1:
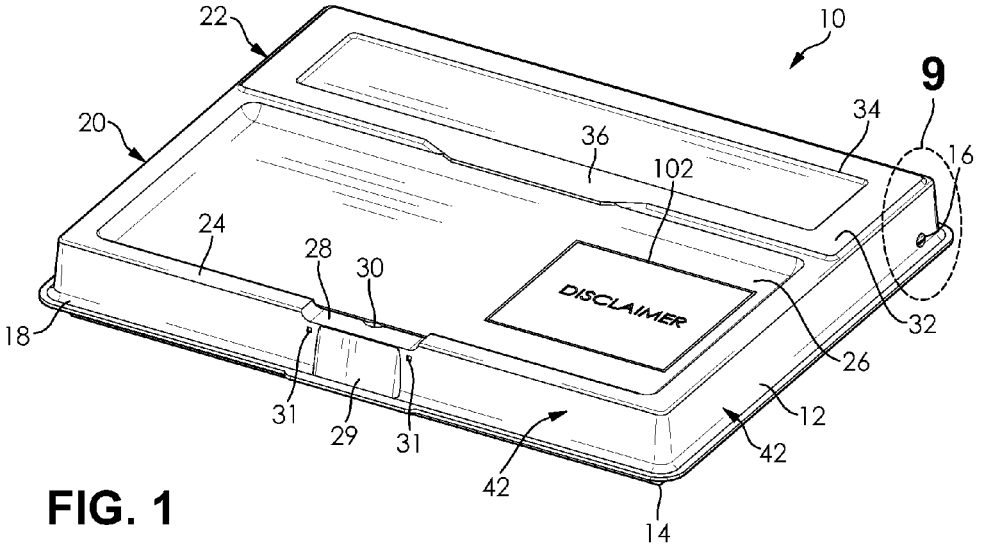
FIG. 1 is a top front perspective view of a document box according to one embodiment of the present disclosure, the document box shown in a closed position.
Figure 2:
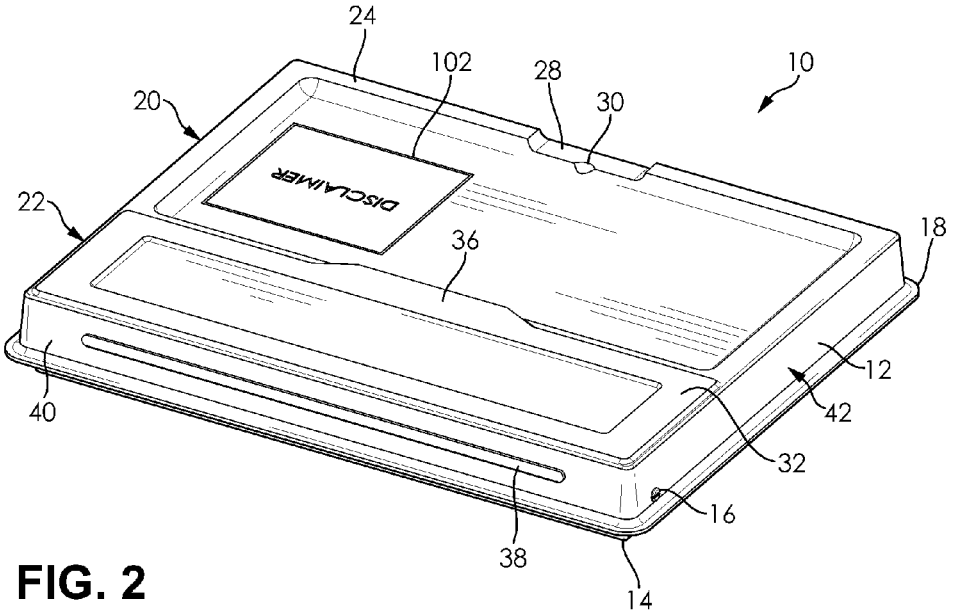
FIG. 2 is a top rear perspective view of the document box shown in FIG. 1.
Figure 3:
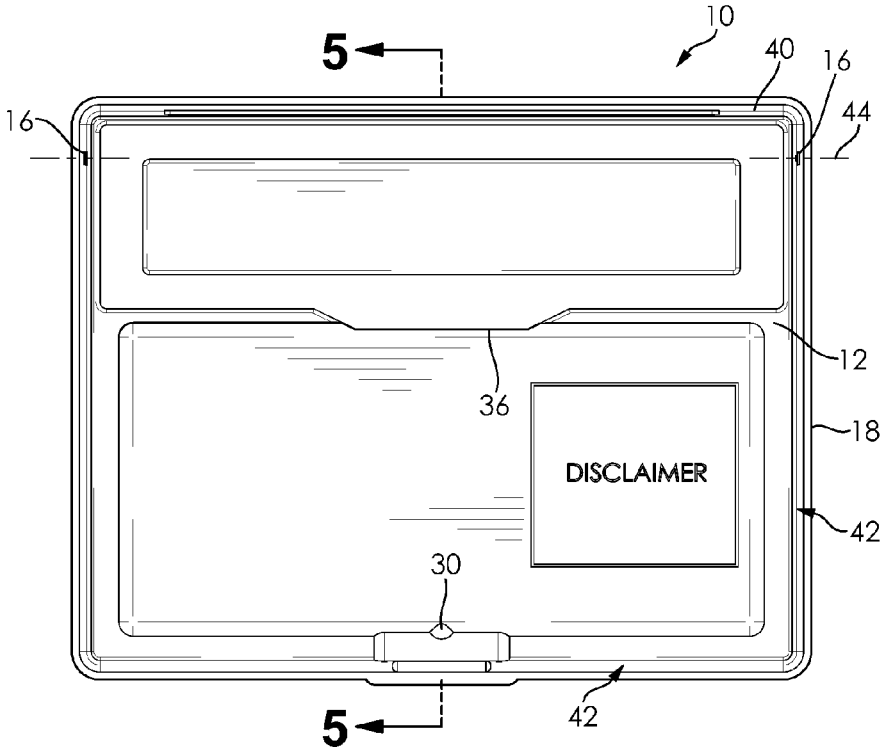
FIG. 3 is a top plan view of the document box shown in FIG. 1.
Figure 4:
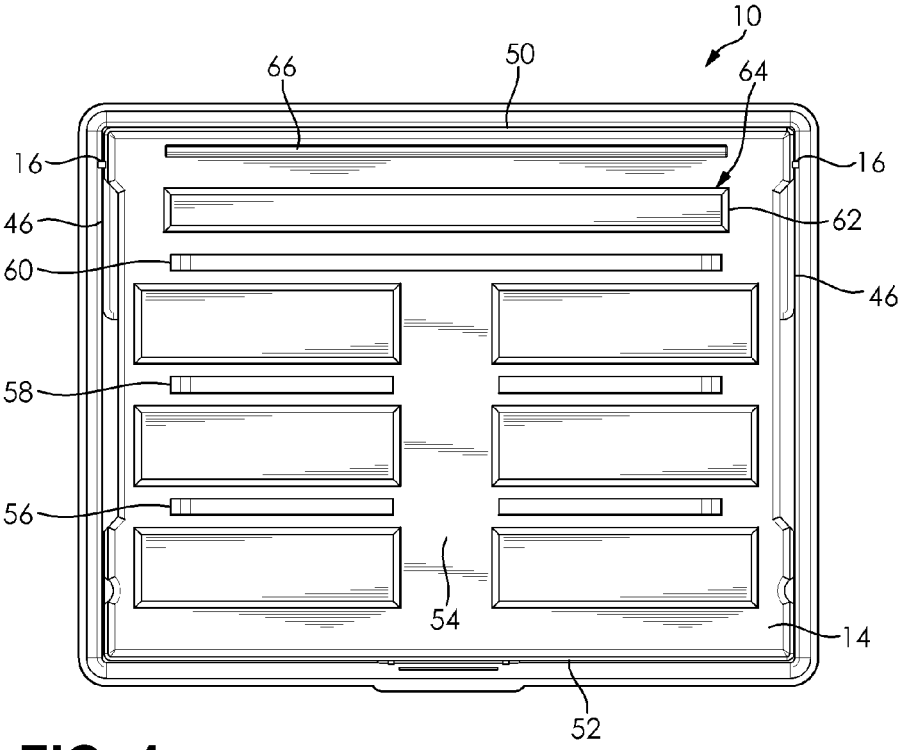
FIG. 4 is a bottom plan view of the document box shown in FIG. 1.

The following detailed description and appended drawings describe and illustrate various exemplary embodiments of the invention. The description and drawings serve to enable one skilled in the art to make and use the invention and are not intended to limit the scope of the invention in any manner. In respect of the methods disclosed, the steps presented are exemplary in nature and, thus, the order of the steps is not necessary or critical.

Referring to FIGS. 1-9, a storage container or document box 10 according to one embodiment of the present disclosure is shown. The document box 10 includes a top container portion 12 and a bottom container portion 14. The top container portion 12 is rotatably connected to the bottom container portion 14 using a pair of hinge fasteners 16 such as screws, rivets, bolts, or other suitable fasteners. The hinge fasteners 16 permit the top container portion 12 to be selectively rotated between a closed position (shown in FIGS. 1-5 and 9) and an open position (shown in FIGS. 6-8), as desired. Radius corners 104 can also be provided at the junction of the various walls of the bottom container portion 14 to assist in rotational opening and closing of the top container portion 12.

With reference to FIGS. 1-5 and 9, the top container portion 12 may have an outwardly extending flanged edge 18. The flanged edge 18 defines an outer circumferential edge integrally connected to, and extending outwardly from, the top container portion 12. The flanged edge 18 facilitates a lifting by hand of the top container portion 12 from the closed position to the open position.

The top container portion 12 of the document box 10 also has a front or first lid portion 20, and a rear or second lid portion 22. The first lid portion 20 includes a raised outer rim 24 creating a recessed cavity 26 within the raised outer rim 24. The recessed cavity 26 provides a location for temporarily placing items such as papers when removed from an interior of the document box, for purposes of inspection.

An opening 28 extends through the outer rim 24 approximately mid-span of the outer rim 24, in a front facing portion of the outer rim 24. The opening 28, together with an outwardly projecting handle portion 29, also facilitates a manual manipulation of the top container portion 12 by a user. The opening 28 may also have a thumb-sized indentation 30, to further facilitate the holding of the top container portion 12 by the user.

As shown in FIGS. 1 and 5-7, the top container portion 12 may also have a pair of raised member 31 disposed on opposite sides of the handle portion 29. The raised members 31 may be formed by indentations formed in an outer surface of the top container portion 12, which cause an inner surface of the top container portion 12 to extend outwardly toward the bottom container portion 14. The raised members 31 are configured to contact a flange 33 of the underlying bottom container portion 14 when the document box 10 is in the closed position. In this manner, the raised members facilitate a selective securement of the document box 10 in the closed position, as desired.

With renewed reference to FIGS. 1-5, the second lid portion 22 of the top container portion 12 also may have an elevated outer rim 32, which in turn defines a recessed cavity 34 in the second lid portion 22. The recessed cavity 34 may be used for holding writing utensils such as pens or pencils on top of the document box 10 while the document box 10 is in the closed position, for example. A lid catch 36 is integrally connected to the outer rim 32 and is directed forward, and can be used to assist the user in rotating the top container portion 12, and to also retain items such as papers temporarily stored in the recessed cavity 26.

It should be understood that the document box 10 of the present disclosure advantageously has a hold open feature that allow the top container portion 12 to be selectively held in the open position when rotated upwardly from the bottom container portion 14. In particular, and as illustrated in FIGS. 2-3, 5 and 7-9, an outwardly extending hollow rib 38 is integrally provided in a rear wall 40 of the top container portion 12. The hollow rib 38 extends outwardly from the rear wall 40, and in turn defines a recess on an inner surface of the rear wall 40. The recess defined by the hollow rib 38 forms part of the hold open feature of the document box 10, the operation of which is described further herein.

Referring to FIGS. 1-3 and 5, a tapering outer wall 42 extends about the two sides and front of the top container portion 12. The outer wall 42 together with the rear wall 40 mitigates against moisture or dirt entering the interior of the storage container 10 in the closed position. Where the storage container 10 is in the closed position, the user can manually contact and apply a lifting force to either the handle portion 29 or the lid catch 36 to rotate the top container portion 12 with respect to a top container rotational axis 44, defined by the axial centerlines of the hinge fasteners 16 shown in FIG. 3.

With reference to FIGS. 4-9, the bottom container portion 14 of the document box 10 provides opposed side walls 46. Each of the opposing walls has an aperture 48 through which one of the hinge fasteners 16 is installed to rotatably connect the top container portion 12 to the bottom container portion 14. The side walls 46, a rear wall 50, and a front wall 52 each taper upwardly and outwardly away from a bottom wall 54. Elongated feet 56, 58, 60 are integrally connected to the bottom wall 54 each have a flat end face upon which the storage container 10 can be supported on a planar surface during use. A contact rib 62 also extends downwardly and outwardly from the bottom wall 54 proximate to the rear wall 50. The contact rib 62 includes an angled face 64.

Figure 5:
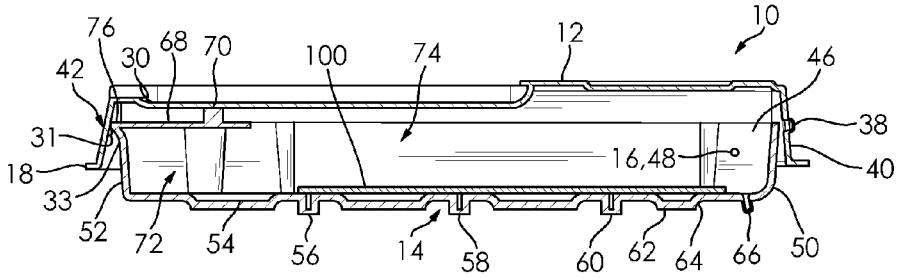
FIG. 5 is a cross sectional side elevational view of the document box taken at section line 5-5 in FIG. 3.
Figure 6:
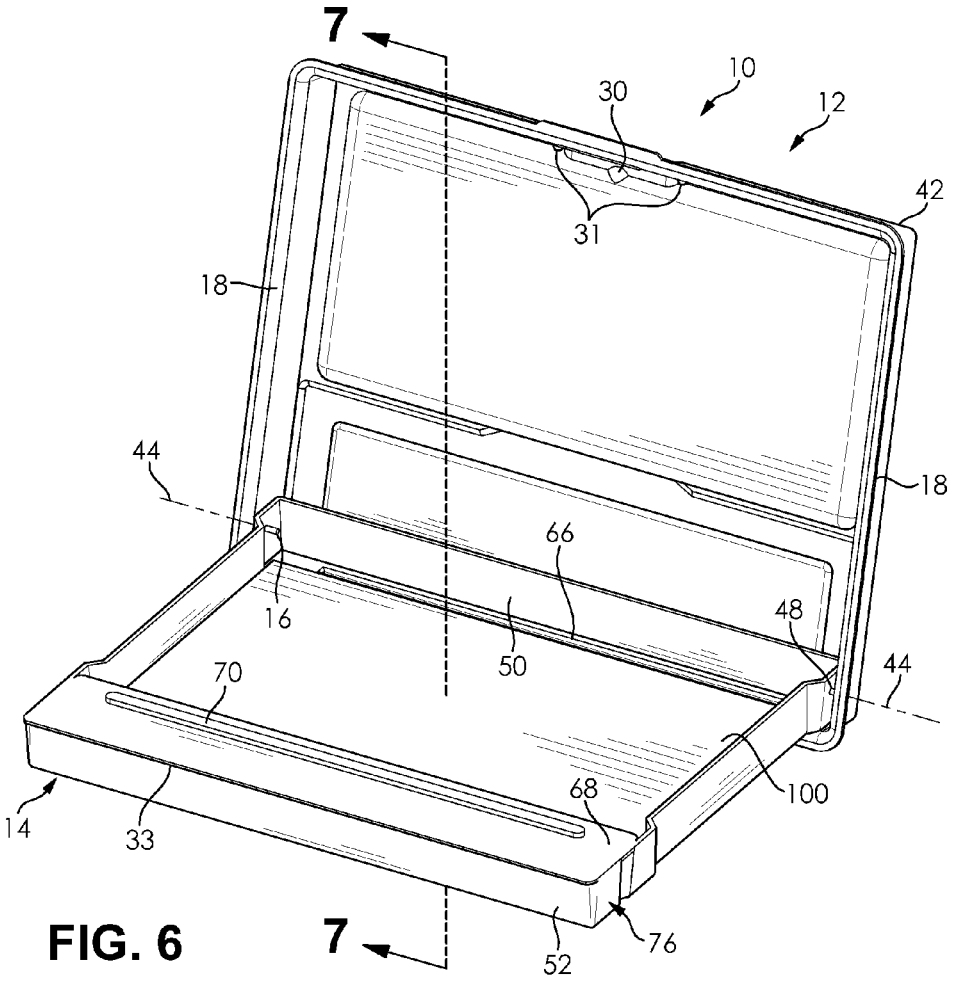
FIG. 6 is a top front perspective view of the document box shown in FIG. 1, the document box shown in an open position.
Figure 7:
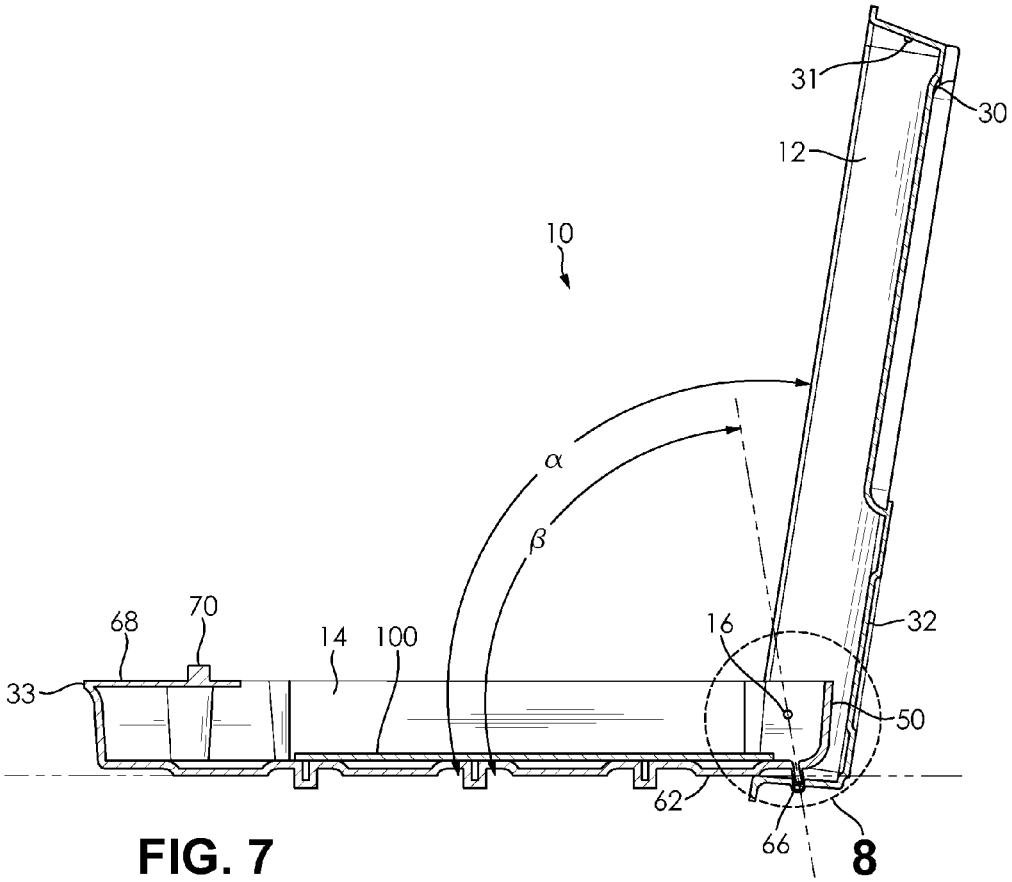
FIG. 7 is a cross sectional side elevational view of the document box taken at section line 6-6 in FIG. 6.
Figure 8:
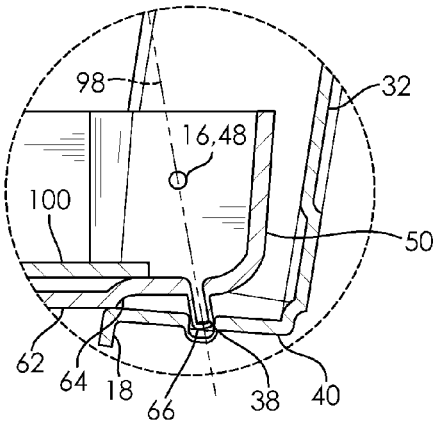
FIG. 8 is an enlarged fragmentary cross sectional side elevational view of the document box identified at callout 8 in FIG. 7.

As shown in FIG. 4-9, an angled raised member 66 is positioned between the contact rib 62 and the rear wall 50. The angled raised member 66 of the bottom container portion 14 is configured to be selectively received and held by the recess defined by the hollow rib 38 of the top container portion 12 when the document box 10 is placed in the open position, for example, as shown in FIGS. 6-8. In this manner, and as described further herein, the hollow rib 38 and the angled raised member 66 together form at least part of the hold open feature of the document box 10.

With reference to FIGS. 5-7, the bottom container portion 14 further includes a planar wall 68 integrally connected to an upper end of the front wall 52. The planar wall 68 is oriented substantially parallel to and spaced apart from the bottom wall 54. The planar wall 68 includes an upwardly raised rib 70, which can provide a positive stop for the top container portion 12 in the closed position. In particular, the raised rib 70 may abut and support an inner surface of the top container portion 12 where in the closed position.

An area between the planar wall 68 and the bottom wall 54 creates a partially enclosed volume 72. A second volume 74, which is larger than the partially enclosed volume 72, is created between the bottom wall 54 of the bottom container portion 14 and the top container portion 12 in the closed position. The partially enclosed volume 72 and the second volume 74 together provide a location for storage of items such as papers in the document box 10.

As shown in FIGS. 5-7, the bottom wall 54 of the bottom container portion 14 can include a planar board 100 provided over a majority of a surface area of the bottom wall 54. The planar board 100 covers and hides underlying features formed in the bottom wall 54, for example, the features forming the feet 56, 58, 60 and the contact rib 62. The planar board 100 may be secured to the bottom wall 54, for example, with mechanical fasteners such as rivets or chemical fasteners such as adhesives, and provides a solid surface onto which items or papers may be placed for storage in the document box 10.

Referring to FIGS. 6-8, additional features of the storage container 10 are visible when the top container portion 12 is rotated away from the bottom container portion 14 from the closed position to the open position. To provide a frictional retention feature to hold the top container portion 12 in the closed position, the bottom container portion 14 includes a flange 76 formed on the front wall 52, which is configured to selectively cooperate with the raised members 31 on the top container portion 12. The raised members 31 may frictionally contact the flange 76 to hold the top container portion 12 at the closed position, as desired.

Additional features of the top container portion 12 and the bottom container portion 14 may further facilitate a holding of document box 10 in the closed position. For example, tapering inner side walls of the top container portion 12 may frictionally contact wall faces of the bottom container portion 14 to also facilitate a releasable holding of the top container portion 12 at the closed position. Further frictional contact can be provided by adding further outwardly extending surfaces to the inner side walls of the top container portion 12, for example. Other suitable means for selectively facilitating a holding of the document box 10 in the closed position may also be employed within the scope of the disclosure.

Referring to FIGS. 6-8, the top container portion 12 may be rotated through an angle of rotation alpha ($\alpha$) greater than 90 degrees, and according to several aspects angle a ranges between approximately 100 to 150 degrees, and most particularly between about 110 to 140 degrees, relative to a plane defined by the bottom wall 54 of the bottom container portion 14, to reach the open position shown. The angled raised member 66 may similarly be angled rearwardly from the bottom container portion 14, for example, at an acute angle gamma ($\gamma$) relative to the plane defined by the bottom wall 54 of the container. It should be appreciated that the angle of rotation alpha ($\alpha$) being greater than 90 degrees causes, in cooperation with receipt of the angled raised member 66 by the hollow rib 38 having the acute angle gamma ($\gamma$), and the positive stop provided by the contact rib 62, the top container portion 12 to remain in the open position where moved there by the user.

A rotational positive stop is provided when direct contact is made between the rear wall 40 of the top container portion 12 and the contact rib 62 extending downwardly from the bottom wall 54 of the bottom container portion 14.

Figure 9:
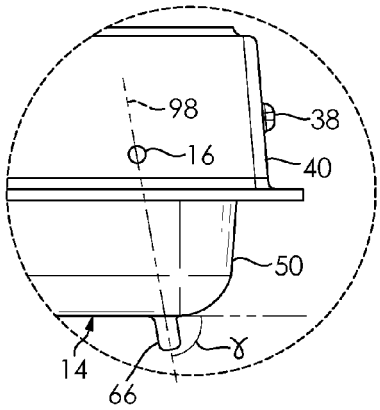
FIG. 9 is an enlarged fragmentary side elevational view of the document box shown in FIG. 1, depicting an angled orientation of a hold open feature on a bottom portion of the document box relative to a plane defined by a base of the bottom portion of the document box.

According to particular embodiments, shown in FIGS. 7 and 9, a longitudinal axis 98 extends through the angled raised member 66. The longitudinal axis 98 may intersect with the top container rotational axis 44 defined by the hinge fasteners 16. An angle beta ($\beta$) may be defined between the bottom container 14 and the longitudinal axis 98, the angle $\beta$ being less than angle $\alpha$.

In operation, the angled raised member 66 located proximate to the rear wall 50 of the bottom container portion 14 engages at least partially, in and thereby cooperates with, the recess or cavity defined by the hollow rib 38 at the rear wall 40 of the top container portion 12. In this manner, the hollow rib 38 functions as a detent to selectively hold the top container portion 12 in the open position shown, through interaction with the angled raised member 66. Contact between the angled raised portion 66 and the hollow recessed rib 38 only occurs at the open position of the document box 10. Engagement of the angled raised portion 66 with the recess defined by the cavity of the hollow recessed rib 38 thereby defines the "hold open" feature for the top container portion 12 of the document box 10 of the present disclosure.

Although shown in FIGS. 5-9 being a single unitary body, the angled raised member 66 of the bottom container portion 12 can, in other embodiments, be provided as multiple and discrete members arranged in a row, for example. Any number of angled raised members 66 may be employed, as desired.

With renewed reference to FIG. 1, it should also be understood that the outer facing surfaces of the top container portion 12, such as the outer surface provided in the recessed cavity 26, can be plain or can be provided with identifying markings. Such identifying markings can include printed stickers, decals, and the like, such as a decal 102 for providing information for the user of storage container 10.

While certain representative embodiments and details have been shown for purposes of illustrating the invention, it will be apparent to those skilled in the art that various changes may be made without departing from the scope of the disclosure, which is further described in the following appended claims.

What is claimed is:

1. A document box, comprising:

a top container portion having a rear wall with a hollow rib integrally disposed thereon; and a bottom container portion rotatably coupled to the top container portion about an axis of rotation, and the top container portion positionable between a closed position and an open position on the bottom container portion, the bottom container portion having a rear wall and a bottom wall, a raised member positioned on the bottom wall adjacent to the rear wall, wherein the top container portion when rotated to the open position releasably positions the raised member within the hollow recessed rib thereby defining a hold open feature for the top container portion.

2. The document box of claim 1, wherein the bottom container portion further has a contact rib extending outwardly from the bottom wall of the bottom container portion, the raised member positioned between the contact rib and the rear wall of the bottom container portion.

3. The document box of claim 2, wherein the contact rib defines a rotational positive stop for the top container portion, the rear wall of the top container portion abutting the contact rib when the top container portion is in the open position.

4. The document box of claim 1, wherein the raised member is angled with respect to a plane defined by the bottom wall of the bottom container portion.

5. The document box of claim 1, where the raised member permits the top container portion to be rotated through an angle of rotation alpha ($\alpha$) greater than 90 degrees relative to a plane defined by the bottom wall of the bottom container portion, from the closed position to the open position.

6. The document box of claim 5, wherein the angle $\alpha$ is between approximately 100 to 150 degrees.

7. The document box of claim 5, wherein the top container portion and the bottom container portion are coupled with a pair of hinge fasteners, the hinge fasteners defining the axis of rotation.

8. The document box of claim 7, wherein the each of the hinge fasteners is disposed through an outer wall of the top container portion and a side wall of the bottom container portion, the side wall arranged between the rear wall and a front wall of the bottom container portion.

9. The document box of claim 7, wherein the raised member has a longitudinal axis extending therethrough, the longitudinal axis intersecting with the axis of rotation with the top container rotational axis to define an angle beta ($\beta$).

10. The document box of claim 9, wherein the angle beta ($\beta$) is less than the angle of rotation alpha ($\alpha$).

11. The document box of claim 1, wherein the top container portion is in peripheral contact with at least a portion of the bottom container portion where in the closed position.

12. The document box of claim 1, wherein the top container portion has a flanged edge.

13. The document box of claim 12, wherein the top container portion has a raised outer rim with an opening formed therein.

14. The document box of claim 13, wherein the top container portion has a handle portion arranged on an outer wall of the top container portion between the opening in the raised outer rim and the flanged edge.

15. The document box of claim 14, wherein the opening in the raised outer rim has a thumb-sized indentation centrally located within the opening.

16. The document box of claim 13, wherein the top container portion has a pair of raised members disposed on opposite sides of the handle portion and extending outwardly from an inner surface of the top container portion.

17. The document box of claim 16, wherein the raised members are configured to cooperate with a flange formed on the front wall of the bottom container portion to selectively hold the top container portion in the closed position.

18. The document box of claim 1, wherein the bottom container portion has a planar wall extending inwardly from a front wall, the planar wall having a raised rib formed thereon, the raised rib configured to abut the top container portion when in the closed position.

19. A document box, comprising:

a top container portion having a rear wall with a hollow rib integrally disposed thereon; and a bottom container portion rotatably coupled to the top container portion about an axis of rotation, and the top container portion positionable between a closed position and an open position on the bottom container portion, the bottom container portion having a rear wall and a bottom wall, an angled raised member positioned on the bottom wall adjacent to the rear wall, the angled raised member permitting the top container portion to be rotated through an angle of rotation alpha ($\alpha$) greater than 90 degrees relative to a plane defined by the bottom wall of the bottom container portion, from the closed position to the open position, and the bottom container portion further having a contact rib extending outwardly from the bottom wall of the bottom container portion, the raised member positioned between the contact rib and the rear wall of the bottom container portion, wherein the top container portion when rotated to the open position releasably positions the angled raised member within the hollow recessed rib thereby defining a hold open feature for the top container portion, and wherein the contact rib defines a rotational positive stop for the top container portion, the rear wall of the top container portion abutting the contact rib when the top container portion is in the open position.

20. A document box, comprising:

a top container portion having a rear wall with a hollow rib integrally disposed thereon, and further having a flanged edge and a raised outer rim with an opening formed therein, a handle portion arranged on an outer wall of the top container portion between the opening in the raised outer rim and the flanged edge, the opening in the raised outer rim having a thumb-sized indentation centrally located within the opening, a pair of raised members disposed on opposite sides of the handle portion and extending outwardly from an inner surface of the top container portion; and a bottom container portion rotatably coupled to the top container portion about an axis of rotation, and the top container portion positionable between a closed position and an open position on the bottom container portion, the top container portion in peripheral contact with at least a portion of the bottom container portion when in the closed position, the bottom container portion having a rear wall and a bottom wall, an angled raised member positioned on the bottom wall adjacent to the rear wall, the angled raised member permitting the top container portion to be rotated through an angle of rotation alpha ($\alpha$) greater than 90 degrees relative to a plane defined by the bottom wall of the bottom container portion, from the closed position to the open position, and the bottom container portion further having a contact rib extending outwardly from the bottom wall of the bottom container portion, the raised member positioned between the contact rib and the rear wall of the bottom container portion, wherein the top container portion when rotated to the open position releasably positions the angled raised member within the hollow recessed rib thereby defining a hold open feature for the top container portion, and wherein the contact rib defines a rotational positive stop for the top container portion, the rear wall of the top container portion abutting the contact rib when the top container portion is in the open position, and wherein the top container portion when rotated to the closed position is selectively held by a cooperation of the raised members with a flange formed on a front wall of the bottom container portion.

* * * * *